US005660029A

United States Patent [19]

King

[11] Patent Number: 5,660,029

[45] Date of Patent: Aug. 26, 1997

[54] CAPSULE FILLER

[76] Inventor: Sidney E. King, 1817 Crescent Dr., Sherman, Tex. 75092

[21] Appl. No.: 560,790

[22] Filed: Nov. 21, 1995

[51] Int. Cl.[6] ..... B65B 1/06; B65B 1/24; B65B 39/06

[52] U.S. Cl. ..... 53/527; 53/281; 53/390; 141/80; 141/391

[58] Field of Search ..... 53/390, 467, 468, 53/471, 281, 284.5, 436, 527; 141/391, 80, 12, 366

[56] References Cited

U.S. PATENT DOCUMENTS

| | | | |
|---|---|---|---|
| 899,761 | 9/1908 | Remington | 53/390 |
| 1,667,066 | 4/1928 | Brown | 53/390 X |
| 2,322,169 | 6/1943 | Smith | 53/390 X |
| 2,742,749 | 4/1956 | McGuire | 53/390 X |
| 3,552,095 | 1/1971 | Inman | 53/390 |
| 4,122,651 | 10/1978 | Braverman | 53/390 |
| 4,685,271 | 8/1987 | Ringer et al. | 53/390 X |
| 5,094,060 | 3/1992 | Caird | 53/390 |
| 5,321,932 | 6/1994 | Sundberg | 53/468 |

*Primary Examiner*—Horace M. Culver
*Attorney, Agent, or Firm*—Jerry C. Ray

[57] ABSTRACT

A low-cost capsule filler has a capsule holder with a medication tray, and cavities in the tray for receiving capsule bodies and capsule covers for filling with powdered or granulated medication. A wall around the medication tray contains loose medication, and the tray surface slopes toward each cavity to facilitate filling. Medication is tamped into the capsules with posts on an extractor; the extractor after tamping is inserted from beneath into the base of the capsule filler so the extractor posts push the filled capsules upward from their cavities where they can be gripped and removed.

6 Claims, 3 Drawing Sheets

CAPSULE FILLER

CROSS REFERENCE TO RELATED APPLICATIONS

None.

BACKGROUND OF THE INVENTION

1. Field of the Invention

This invention relates to devices for manually introducing medication and other materials into gelatin capsules, and especially to such devices for use in a home or hospice setting where limited production is acceptable.

2. Description of the Related Art

Filling capsules with medication is generally accomplished using machines for mass production, or hand-filling techniques for more limited quantities. A special difficulty arises when it is desirable to fill a few capsules at a time, such as for home treatment of one or two patients. The difficulty may be compounded if a patient is unable to control swallowing, and cannot take medication orally. In this latter case the only way to administer medication may be rectally, by means of capsules.

Prescription medicines often are dispensed in tablet form; if the patient cannot swallow tablets they can be broken up or crushed, placed in capsules, and administered rectally. Because it is preferable for the patient to receive the medication in as few capsules as possible, a method of overfilling the capsules is desirable. Overfilling is accomplished by introducing medication into both the capsule body and the cap, so that the capsules contain a greater quantity of medication and fewer capsules are needed.

Another problem with filling a few capsules manually is wasted medication; the process is difficult to accomplish without spillage and waste, and requires considerable dexterity to accomplish at all. Therefore a need exists for a device to facilitate filling capsules with medication a few at a time, and which allows filling both body and cap of the capsules with the maximum possible quantity of medication.

Of the patents listed below, Austin discloses a capsule-filling machine for large-scale production. Sundberg discloses a capsule handling system for filling several dozen capsules at once. Hayashi, et al. disclose a device having rotating plates with cam-operated means for positioning, filling, and closing the capsules. Similarly, Inman discloses an arrangement of rotating plates with a chamber for dispensing powdered medication into capsule bodies held in openings in a lower plate.

The following patents were developed by a pre-examination search, and are here listed for consideration by the Examiner:

| Patent Number | Issue Date | Patentee |
|---|---|---|
| 3,552,095 | Jan. 5, 1971 | Inman |
| 3,554,412 | Jan. 12, 1971 | Hayashi, et al. |
| 3,675,390 | Jul. 11, 1972 | Austin |
| 5,321,932 | Jun. 21, 1994 | Sundberg |

SUMMARY OF THE INVENTION

The invention is an easy-to-use, low-cost device for filling small quantities of capsules with powdered or granulated medication. The capsule filler may be used in home, hospice, pharmacy, or hospital, anywhere capsules for one or two patients need to be filled individually. The capsule filler includes a capsule holder with cavities to hold capsule bodies and covers. Surrounding the cavities is a medication tray which slopes down toward capsules positioned in the cavities. Medication is introduced into the capsule parts by being placed on the tray and transferred into the capsules, where it is tamped with a dual-use extractor. Next, excess medication is removed from the tray back into a container, to avoid waste.

Posts on the extractor are of a length to effectively tamp medication into the capsules; then the extractor is reversed and inserted into the base of the holder. There the extractor posts fit into openings in the bottom of each cavity, and lift the filled capsules for grasping and removal.

Given the foregoing, an object of this invention is to provide a device, suitable for use in the home or elsewhere, for filling capsules with medication.

Another object is to provide such a device which will avoid spilled and wasted medication, and which will fill a capsule with the maximum amount of medication.

A further object is for the capsule-filling device to be suitable for filling a small number of capsules, as when used to fill capsules for only one or two patients.

Further objects are to achieve the above with devices that are sturdy, compact, durable, lightweight, simple, safe, efficient, and reliable, yet inexpensive and easy to manufacture, operate, and maintain.

The specific nature of the invention, as well as other objects, uses, and advantages thereof, will clearly appear from the following description and from the accompanying drawings, the different views of which are not necessarily scale drawings.

CATALOG OF THE ELEMENTS

To aid in the correlation of the elements of the invention to the exemplary drawings, the following catalog of the elements is provided:

| | |
|---|---|
| 10 | Capsule holder |
| 12 | Medication tray |
| 14 | Tray wall |
| 16 | Base |
| 18 | Cavity |
| 20 | Cavity wall |
| 22 | Cavity basal opening |
| 24 | Extractor |
| 26 | Post |

DESCRIPTION OF THE PREFERRED EMBODIMENTS

Figure 1:
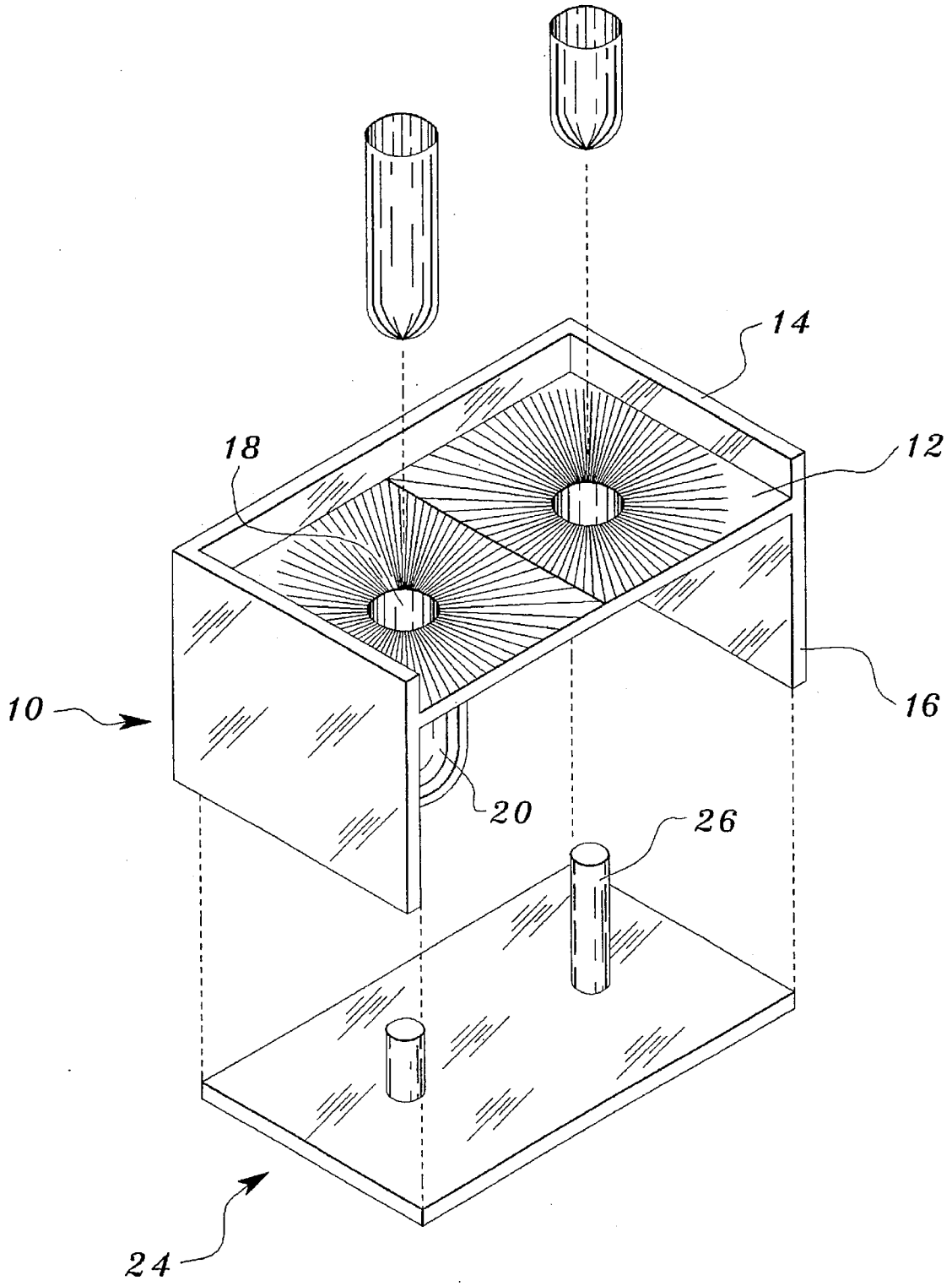
FIG. 1 is a front perspective of the capsule filler and the extractor.

Referring to the drawings, FIG. 1 is a perspective view of the invention showing the capsule holder 10 and the capsule extractor 24. Capsule holder and base are made of plastic; the preferred method of manufacture is by injection molding. Dimensions of the two pieces will vary, depending on the capsule size for which it is intended; generally the capsule holder will be about 3" long by 1½ wide by 1½ tall. The capsule holder and the extractor have dimensions such that the extractor 24 fits within the base of the holder 10, as described below.

Figure 2:
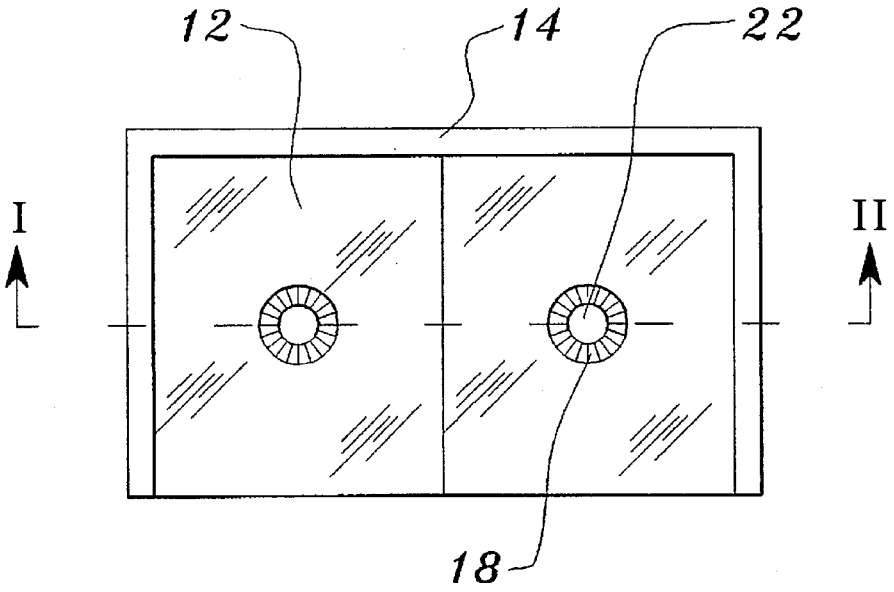
FIG. 2 is a plan view of the capsule filler.
Figure 4:
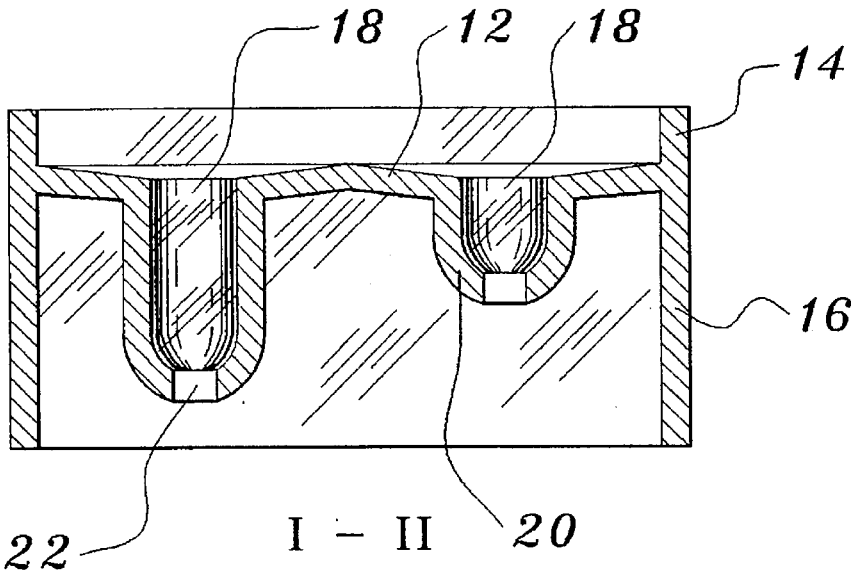
FIG. 4 is a cross section I–II of the capsule filler shown in FIG. 2.

Referring to FIG. 2 and FIG. 4, the capsule holder has a medication tray 12 with two or more cavities 18 therein. Each cavity 18 is defined by a cavity wall 20 which extends downward from, and is integral with, the medication tray 12. As shown in the cross-section in FIG. 2, a surface of the medication tray surrounding each cavity is sloped downward toward the cavity. In the preferred embodiment, in which the capsule holder which has two cavities, the medication tray is divided into two portions, each sloping toward a cavity in the center of that portion.

Referring again to FIGS. 1 and 2, the medication tray 12 has an integral base 16 which supports the capsule filler on a counter, table or other surface. The base extends around three sides of the medication tray, leaving a front side of the capsule filler open. The three-sided base 16 extends upward to form a low wall 14 which surrounds the medication tray on three sides. Tray wall 14 and base 16 are integral. The wall serves to contain powdered or granular medication which is placed on the medication tray for transfer into the capsule body and the capsule cover.

Cavities 18 in the medication tray 12 are sized to hold capsules of two or more sizes. In this description, the longer portion of a capsule is referred to as the capsule body, and the shorter, wider portion which mates with the body is called the capsule cover. It is contemplated that at least one set of the cavities will be sized to hold capsules of a size which may be administered rectally.

The depth of the cavities 18 is such that a capsule body and cover, when placed in their respective cavities, will rest on the bottom of the cavity with a top of the capsule body and the capsule cover slightly below an upper surface of the medication tray 12.

After a capsule body and cover are inserted into the appropriate cavities, powdered or granulated medication is placed on the medication tray. Medication is transferred into the capsule body and cover by raking with a spatula, by tapping the capsule holder, or by a combination of these. It is understood that the size of the capsule filler allows it to be held in the hands during the filling process, where tilting and/or tapping the capsule filler will facilitate transferring powdered medication into the capsule body and cover.

Figure 3:
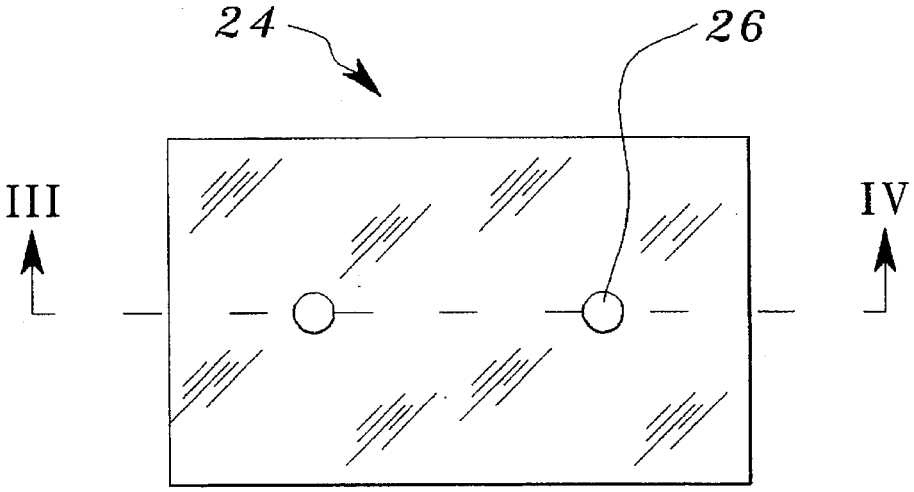
FIG. 3 is a plan view of the extractor.
Figure 5:
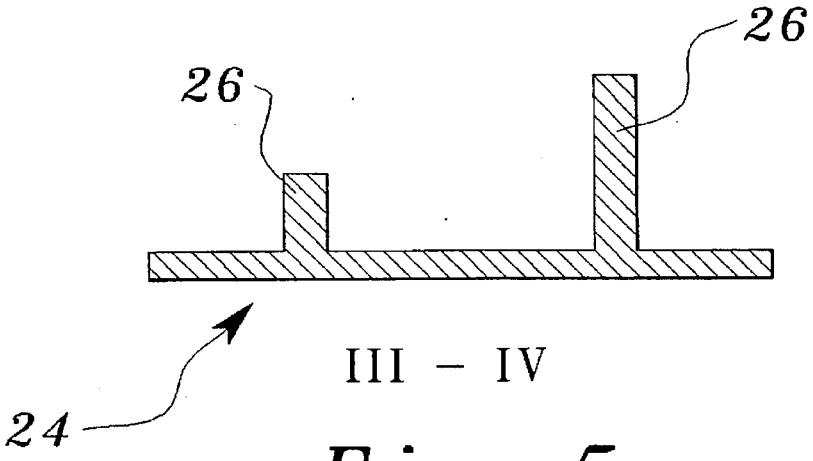
FIG. 5 is a cross section III–IV of the extractor shown in FIG. 3.

Medication may be tamped into the capsule body and cover by the posts 26 on the extractor 24. As shown in FIG. 3 and in cross-section in FIG. 5, the extractor 24 is substantially rectangular and planar, with two posts 26 of unequal length extending from one side thereof. A primary purpose of the posts 26 is to extract filled capsules from their respective cavities, as described below. Tamping is desirable in order to place a maximum amount of medication into the capsule body and cover, so that fewer capsules may be used to deliver the prescribed quantity of medication. During tamping, the extractor is positioned so that the longer post tamps material in the capsule body, and the shorter post tamps the capsule cover. After tamping, the capsule holder is tilted to transfer excess medication from the medication tray into its container, avoiding waste.

After tamping and removal of excess medication, the position of the extractor 24 is reversed, and the extractor is inserted, from beneath the capsule filler, into the opening formed by the walls of the base 16. The extractor is sized to fit closely within the walls of the base, so the walls serve to guide the extractor as it is moved upwards. The extractor 24 is pushed upwards until posts on the extractor engage openings 22 in the lower, basal end of each cavity 18. The posts 26 are of a length so that when the extractor 24 is pushed fully upward, against the lower end of the cavity walls, the filed capsule body and cover are lifted by the extractor posts and extend above the medication tray a sufficient distance to be gripped with fingers and removed. Then the person filling capsules uses his or her fingers to align the capsule cover over the body and press the two together to make a complete, fully filled capsule.

The embodiments shown and described above are only exemplary. I do not claim to have invented all the parts, elements, or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. A device for manually filling capsules with medication, comprising:

a) a capsule holder having a medication tray, a tray wall, and a base, b) said medication tray having cavities therein for receiving capsule bodies and capsule covers, said cavities having a predetermined width and depth, c) an extractor having extractor posts extending therefrom, d) said posts being spaced apart to match a distance between said cavities, e) said medication tray having cavities in a central portion thereof, f) said medication tray having a surface sloping downward toward said cavities, g) at least one of said cavities is sized to receive capsule bodies, and h) at least one of said cavities is sized to receive capsule covers, so that medication may be introduced into both said bodies and said covers.

2. The invention as described in claim 1, wherein:

j) said base is three-sided, and k) said tray wall is integral with said base and surrounds three sides of said medication tray.

3. The invention as described in claim 1, wherein:

l) said extractor has exterior dimensions for fitting within walls of said capsule holder base.

4. The invention as described in claim 1, wherein:

m) each extractor post is of a predetermined length so that each post is of a length to tamp medication into a capsule body, and is of a length to extract capsule bodies from cavities in said capsule holder.

5. The invention as described in claim 1, wherein:

l) said extractor has exterior dimensions for fitting within walls of said capsule holder base.

6. The invention as described in claim 1, wherein:

m) each extractor post is of a predetermined length so that each post is of a length to tamp medication into a capsule body, and is of a length to extract capsule bodies from cavities in said capsule holder.

* * * * *